US006453886B2

(12) United States Patent
Takano et al.

(10) Patent No.: US 6,453,886 B2
(45) Date of Patent: Sep. 24, 2002

(54) THROTTLE VALVE CONTROL APPARATUS

(75) Inventors: Hiroyuki Takano, Kakuda; Katsuhiro Kanno, Sendai, both of (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 09/867,572

(22) Filed: May 31, 2001

(30) Foreign Application Priority Data

May 31, 2000 (JP) ..... 2000-163264

(51) Int. Cl.[7] ..... F02D 9/08; F02M 33/04; F02M 25/08

(52) U.S. Cl. ..... 123/520; 123/337

(58) Field of Search ..... 123/520, 698, 123/337, 73 AD

(56) References Cited

U.S. PATENT DOCUMENTS 5,448,981 A * 9/1995 Cook et al. ..... 123/516
5,727,531 A * 3/1998 Osanai ..... 123/306
6,152,115 A * 11/2000 Busato et al. ..... 123/520
6,182,641 B1 * 2/2001 Yamada et al. ..... 123/357

* cited by examiner

*Primary Examiner*—Tony M. Argenbright
*Assistant Examiner*—Hai H. Huynh
(74) *Attorney, Agent, or Firm*—Paul A. Guss

(57) ABSTRACT

A purge control valve is directly connected to the fourth side surface of the main throttle body. The purge control valve comprises a main valve body, an introducing nozzle, and a discharge nozzle installed to penetrate from a bottom surface of the main valve body to a fourth side surface of a main throttle body. The discharge nozzle communicates with a communicating passage which is formed in an axial direction of an intake passage in the main throttle body. The communication passage communicates with a purge passage which is formed to have a circular arc-shaped cross section having a substantially constant width along an outer circumference of the intake passage so that an outlet surface may be cut out.

6 Claims, 4 Drawing Sheets

THROTTLE VALVE CONTROL APPARATUS

BACKGROUND OF THE INVENTION

1. Field of the Invention

The present invention relates to a throttle valve control apparatus which is connected to a predetermined equipment including, for example, an intake manifold of an internal combustion engine. Specifically, the present invention relates to a throttle valve control apparatus to which a purge control valve is directly connected.

2. Description of the Related Art

In general, evaporating fuel is generated in a fuel tank for storing fuel to be used to drive an engine. However, the evaporating fuel emitted to the atmospheric air causes the atmospheric pollution. Therefore, the evaporating fuel is purged (aspirated) to an intake passage which is formed in a main throttle body of a throttle valve control apparatus communicating with a cylinder chamber of the engine so that the evaporating fuel may be combusted together with the air-fuel mixture.

For purging the evaporating fuel to the intake passage, a method is known in which the evaporating fuel generated in the fuel tank is once adsorbed to a canister composed of activated carbon and, then, the fuel adsorbed to the canister is purged to the intake passage during a loading operation of the engine under the control of a purge control valve. In this case, the purge control valve and the throttle valve control apparatus are connected to one another by a piping. Further, in order to make communication between the piping and the intake passage, a purge hole having a small diameter is formed on a surface parallel to a throttle shaft to which a throttle valve of a main throttle body is fixed and held. That is, when the throttle valve of the throttle valve control apparatus is opened, the evaporating fuel is purged through the purge hole to the intake passage in accordance with the aspirating pressure of air flowing through the intake passage.

In the above conventional technique, the purge control valve and the throttle valve control apparatus are connected to one another by the piping. Therefore, it is necessary for the evaporating fuel to flow over a distance corresponding to the length of the piping during a period ranging from the opening of the throttle valve of the throttle valve control apparatus until the evaporating fuel is purged to the intake passage under the control of the purge control valve. A long period of time is needed until the evaporating fuel arrives at the intake passage corresponding thereto. In other words, the following inconvenience arises that the evaporating fuel is not purged to the intake passage quickly after the throttle valve is opened, thereby resulting in unsatisfactory response performance with respect to the operation of the throttle valve.

Furthermore, the purge hole having the small diameter is formed on the surface parallel to the throttle shaft of the main throttle body. Therefore, the distance between the throttle valve and the outlet of the purge hole (communicating portion with respect to the intake passage) varies depending on the opening/closing operation of the throttle valve. The pressure is also fluctuated in the vicinity of the outlet of the purge hole. In addition thereto, the purge amount of the evaporating fuel varies. Accordingly, the problem arises that it is impossible to reliably purge the evaporating fuel generated in the fuel tank to the intake passage. Furthermore, it is difficult to purge the evaporating fuel at a sufficient flow rate because the purge hole has the small diameter.

SUMMARY OF THE INVENTION

The present invention has been made taking the foregoing problems into consideration, an object of which is to provide a throttle valve control apparatus which makes it possible to quickly purge the evaporating fuel in response to the operation of a throttle valve, and which makes it possible to reliably purge the evaporating fuel at a desired flow rate without being affected by the opening/closing operation of the throttle valve.

According to the present invention, there is provided a throttle valve control apparatus provided with a purge control valve for controlling a flow rate of evaporating fuel to be purged to an intake passage formed in a main throttle body; wherein the purge control valve is directly connected to a surface which is substantially parallel to a throttle shaft of the main throttle body; and wherein a discharge nozzle of the purge control valve communicates with a purge passage which is formed on an end surface of the intake passage of the main throttle body in an axial direction, and a communicating section between the intake passage and the purge passage is provided at the inside of a wall surface of the main throttle body which holds the throttle shaft.

In the above arrangement, it is unnecessary to provide any piping for connecting the purge control valve and the throttle valve control apparatus. Therefore, the distance between the discharge nozzle of the purge control valve and the intake passage formed in the main throttle body of the throttle valve control apparatus can be shortened as short as possible. Accordingly, it is possible to quickly purge the evaporating fuel to the intake passage in response to the operation of the throttle valve.

Furthermore, the discharge nozzle of the purge control valve communicates with the intake passage via the purge passage, and the communicating section between the purge passage and the intake passage is located in the vicinity of the throttle shaft. Therefore, the distance between the throttle valve and the outlet of the purge passage (communicating section with respect to the intake passage) does not vary, which would be otherwise caused if the throttle valve performs the opening/closing action. Accordingly, the outlet of the purge passage can be prevented, as less as possible, from being affected by the pressure fluctuation due to the opening/closing action of the throttle valve. As a result, it is possible to reliably purge the evaporating fuel at a desired flow rate.

Furthermore, because the purge passage is formed on the end surface of the intake passage of the main throttle body in the axial direction, the purge passage can be simultaneously formed when, for example, the main throttle body is formed by means of die casting. Therefore, it is unnecessary to form the purge passage by applying machining processes such as drilling or the like after the main throttle body is formed. Accordingly, it is easy to form the purge passage.

In the throttle valve control apparatus constructed above, it is preferable that the purge passage is formed to have a circular arc-shaped configuration having a substantially constant width along an outer circumference of the intake passage for the following reason. The purge passage communicating with the intake passage has a predetermined volume unlike the conventional purge hole having the small diameter. Therefore, it is possible to reliably purge the evaporating fuel at a desired flow rate.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

The throttle valve control apparatus according to the present invention will be exemplified by a preferred embodiment, which will be explained in detail below with reference to the accompanying drawings of FIGS. 1 to 4. Although the way of using the throttle valve control apparatus is not specifically limited, it is assumed in this embodiment that the throttle valve control apparatus is used by being connected to an intake manifold for feeding the air into a cylinder chamber of a fuel injection type engine of an automobile.

Figure 1:
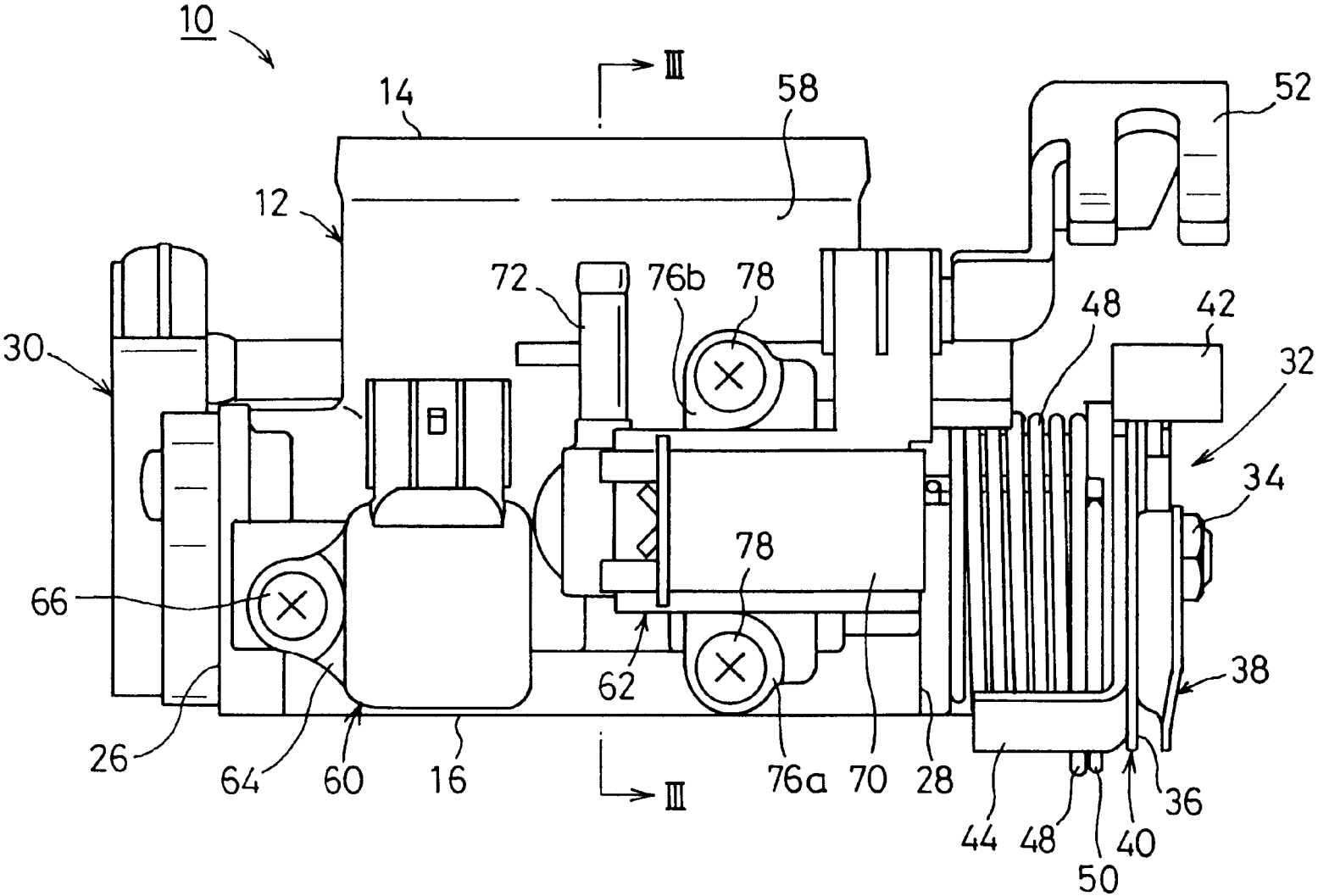
FIG. 1 shows a front view illustrating a throttle valve control apparatus according to an embodiment of the present invention.
Figure 2:
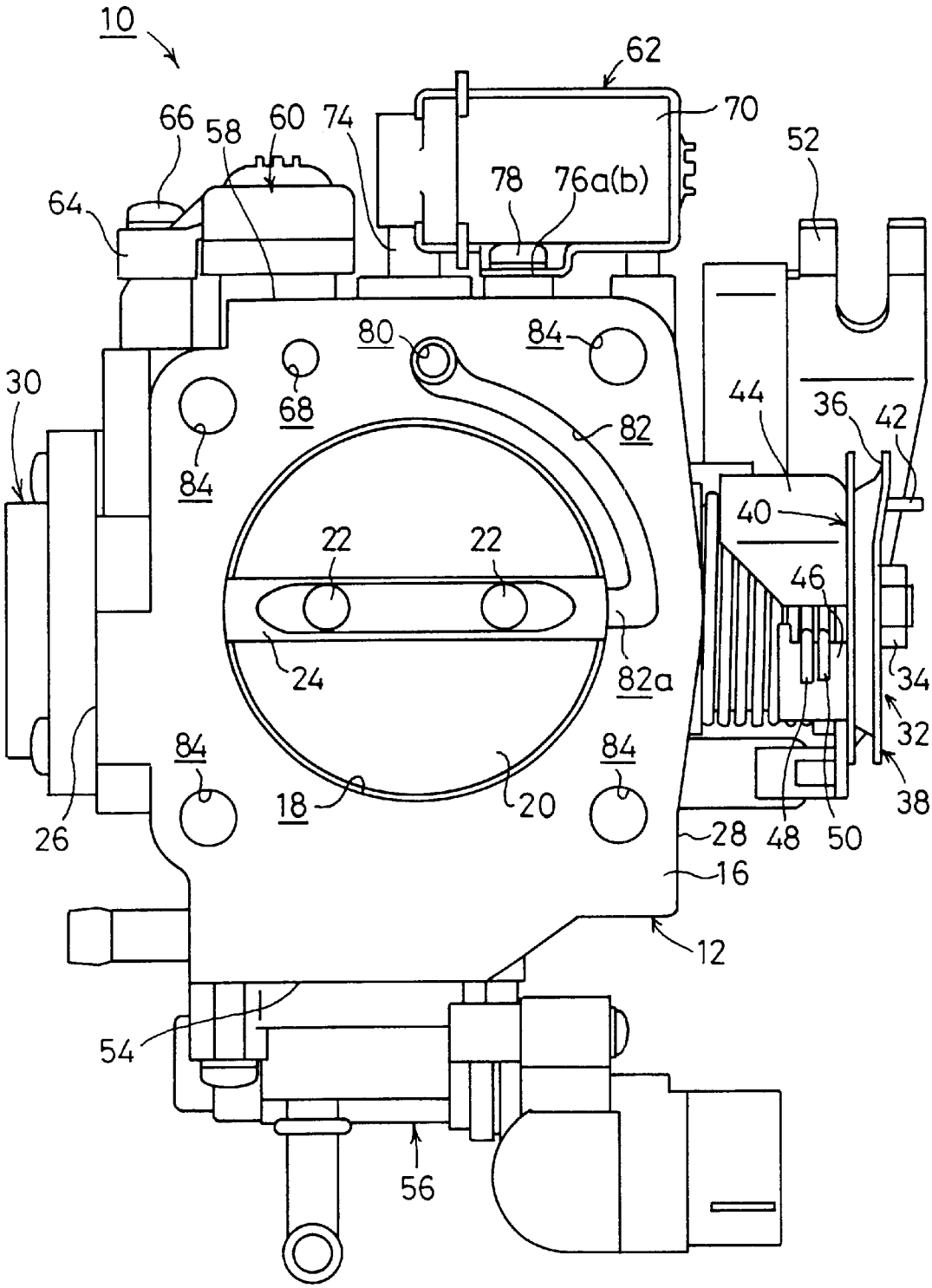
FIG. 2 shows a bottom view illustrating the throttle valve control apparatus shown in FIG. 1.

As shown in FIGS. 1 and 2, a throttle valve control apparatus 10 according to the embodiment of the present invention has a main throttle body 12. The main throttle body 12 is provided with an inlet surface 14, and an outlet surface 16 which is substantially parallel to the inlet surface 14. An intake passage 18 for supplying the air into the cylinder chamber of the engine is formed at a substantially central portion of the main throttle body 12 so that the intake passage 18 may communicate with the inlet surface 14 and the outlet surface 16 described above (see FIG. 2). A throttle valve 20 for opening/closing the intake passage 18 is arranged rotatably in the intake passage 18. The throttle valve 20 is held and fixed to a throttle shaft 24 by the aid of screws 22, 22 (see FIG. 2).

The throttle shaft 24 penetrates through the intake passage 18 in a perpendicular direction to the axial direction of the intake passage 18. The throttle shaft 24 further protrudes and extends from a first side surface 26 of the main throttle body 12 and a second side surface 28 which is substantially parallel to the first side surface 26. An opening degree sensor 30 for detecting a rotated angle of the throttle valve 20 is attached to the first side surface 26. A first end of the throttle shaft 24 is directly fitted to a rotor (not shown) of the opening degree sensor 30 (see FIG. 1). A throttle lever 32 is installed to a second end of the throttle shaft 24. A nut 34 for holding the throttle lever 32 against disengagement is screwed into the throttle shaft 24 (see FIGS. 1 and 2).

The throttle lever 32 includes a guide section 38 which has a wire-engaging section 36 with a substantially U-shaped cross section, and a disk section 40 which is fixed to the guide section 38. A first end of an accelerator wire (not shown) is fixed to a first end of the wire-engaging section 36. A second end of the accelerator wire is connected to an accelerator pedal (not shown).

The disk section 40 is provided with a first pawl 42 and a second pawl 44 which are directed mutually opposingly in the axial direction of the throttle shaft 24. A spring-fastening section 46 directed inwardly in the axial direction of the throttle shaft 24 is secured to the disk section 40 (see FIG. 2). Further, a first return spring 48 is interposed between the second side surface 28 and the disk section 40 so that the throttle shaft 24 may be surrounded thereby. A first end of the first return spring 48 is fastened to the spring-fastening section 46. A second end of the first return spring 48 is fastened to the main throttle body 12. A second return spring 50 is arranged in radially inward relation to the first return spring 48. That is, the first return spring 48 and the second return spring 50 have different diameters respectively and are installed in coaxial relation to the throttle shaft 24. The first return spring 48 and the second return spring 50 restore the throttle valve 20 being rotated by a predetermined angle to the original position.

In FIG. 1, reference numeral 52 indicates a throttle stay which is fixed to the second side surface 28 of the main throttle body 12.

An idle speed control valve 56 is directly connected to a third side surface 54 which is substantially parallel to the throttle shaft 24 of the main throttle body 12. The idle speed control valve 56 controls the flow rate of the air so that, during the idling, the air may be fed at an optimum flow rate into the cylinder chamber of the engine. Specifically, the flow rate is controlled as follows: the flow rate of the air to be fed is relatively increased when the engine is cold; the flow rate is gradually decreased when the engine is progressively warmed; and the flow rate becomes substantially constant after the warming has been completed. Since a general solenoid-operated valve is used for the idle speed control valve 56, detailed explanation thereof will be omitted.

As shown in FIGS. 1 and 2, a negative pressure sensor 60 and a purge control valve 62 are arranged parallel on a fourth side surface 58 which is substantially parallel to the third side surface 54 of the main throttle body 12. The negative pressure sensor 60 detects the pressure in the intake passage 18. The negative pressure sensor 60 is supported and fixed to the fourth side surface 58 by the aid of a bolt 66 penetrating through a support section 64 of the negative pressure sensor 60. A negative pressure passage 68 is formed to communicate with the negative pressure sensor 60 from the outlet surface 16 of the main throttle body 12. The negative pressure passage 68 communicates with an intake manifold (not shown) which is connected to the outlet surface 16. That is, the intake passage 18 and the negative pressure passage 68 are in a communicated state. Therefore, the air fed from the intake manifold to the engine is aspirated, and the pressure in the intake passage 18 is detected by the negative pressure sensor 60.

The purge control valve 62 includes a main valve body 70, an introducing nozzle 72 (see FIG. 1) for introducing the evaporating fuel, and a discharge nozzle 74 (see FIG. 2) which is penetratingly inserted from the bottom surface of the main valve body 70 into the fourth side surface 58 of the main throttle body 12. The purge control valve 62 is being directly connected to the fourth side surface 58 (see FIGS. 1 and 2) by the aid of bolts 78, 78 inserted through a pair of support sections 76*a*, 76*b* (see FIG. 1) which are provided for the main valve body 70.

Figure 3:
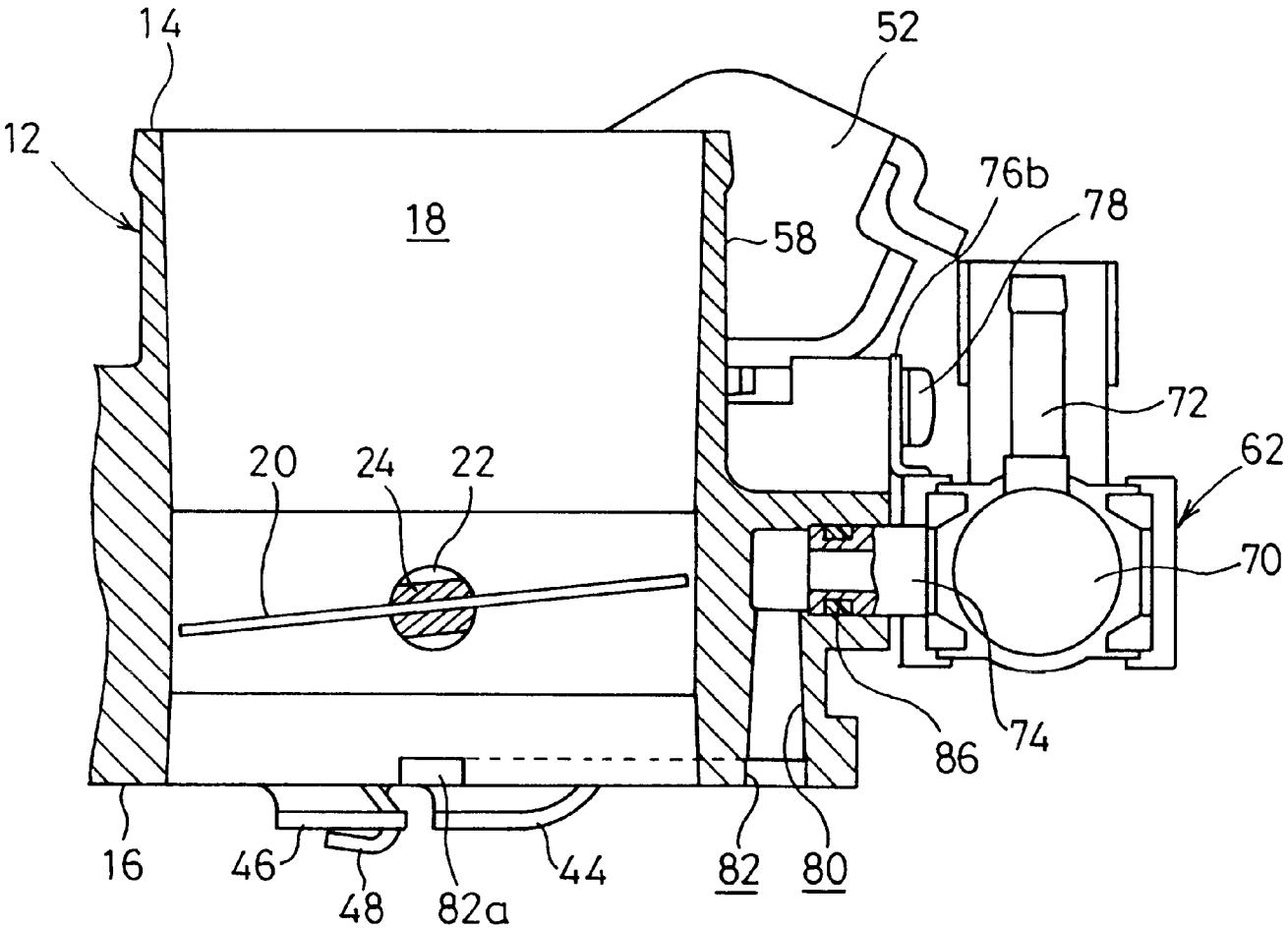
FIG. 3 shows, with partial omission, a sectional view illustrating major parts as viewed along a line III—III shown in FIG. 1.

As shown in FIG. 3 which is a sectional view as viewed along a line III—III shown in FIG. 1, the discharge nozzle 74 communicates with a communicating passage 80 which is formed to widen gradually toward the outlet surface 16 in the axial direction of the intake passage 18. The communicating passage 80 communicates with a purge passage 82 which is formed to have a circular arc-shaped cross section having a substantially constant width along the outer circumference of the intake passage 18 so that the outlet surface 16 may be cut out. As clearly understood from FIG. 3, an outlet 82*a* of the purge passage 82 communicates with the intake passage 18 at a position (in the vicinity of the throttle shaft 24) where the axis of the throttle shaft 24 is translated in parallel in the axial direction of the intake passage 18. That is, the discharge nozzle 74 of the purge control valve 62 communicates with the intake passage 18 via the communicating passage 80 and the purge passage 82.

In FIG. 2, reference numeral 84 indicates a bolt hole for connecting the main throttle body 12 and the intake manifold. In FIG. 3, reference numeral 86 indicates a seal member.

The throttle valve control apparatus 10 according to the embodiment of the present invention is basically constructed as described above. Next, explanation will be made for the operation to be performed after the accelerator pedal is operated (accelerator pedal is pedaled) until the operation thereof is ceased.

When the accelerator pedal (not shown) is operated at first, the accelerator wire (not shown) is tensioned which is connected to the accelerator pedal. The wire-engaging section 36 to which the first end of the accelerator wire is fixed, i.e., the throttle lever 32 is rotated from the original position. Therefore, the throttle shaft 24 is rotated integrally with the throttle lever 32. The throttle valve 20 is rotated by a predetermined angle to open the intake passage 18. Accordingly, the air flows through the intake passage 18.

During this process, the evaporating fuel generated in the fuel tank is introduced, via a canister composed of activated carbon, into the introducing nozzle 72 of the purge control valve 62 in accordance with the aspirating pressure of the air flowing through the intake passage 18. Introduced from the introducing nozzle 72, the evaporating fuel passes through the main valve body 70 and is discharged from the discharge nozzle 74. The flow rate of the evaporating fuel is controlled depending on the opening degree of the valve plug (not shown) which is provided at the inside of the main valve body 70.

Discharged from the discharge nozzle 74, the evaporating fuel flows through the communicating passage 80 formed in the main throttle body 12 and the purge passage 82 formed at the outlet surface 16 of the main throttle body 12, and it is purged to the intake passage 18. Accordingly, the evaporating fuel is fed to the cylinder chamber together with the air-fuel mixture prepared just before the cylinder chamber of the engine, and it is subjected to the combustion process.

The operation of the accelerator pedal is ceased thereafter. The throttle lever 32 is rotated in the direction to return to the original position in accordance with a tensioning action of the first return spring 48 and the second return spring 50, thereby allowing the throttle valve 20 to close the intake passage 18.

Figure 4:
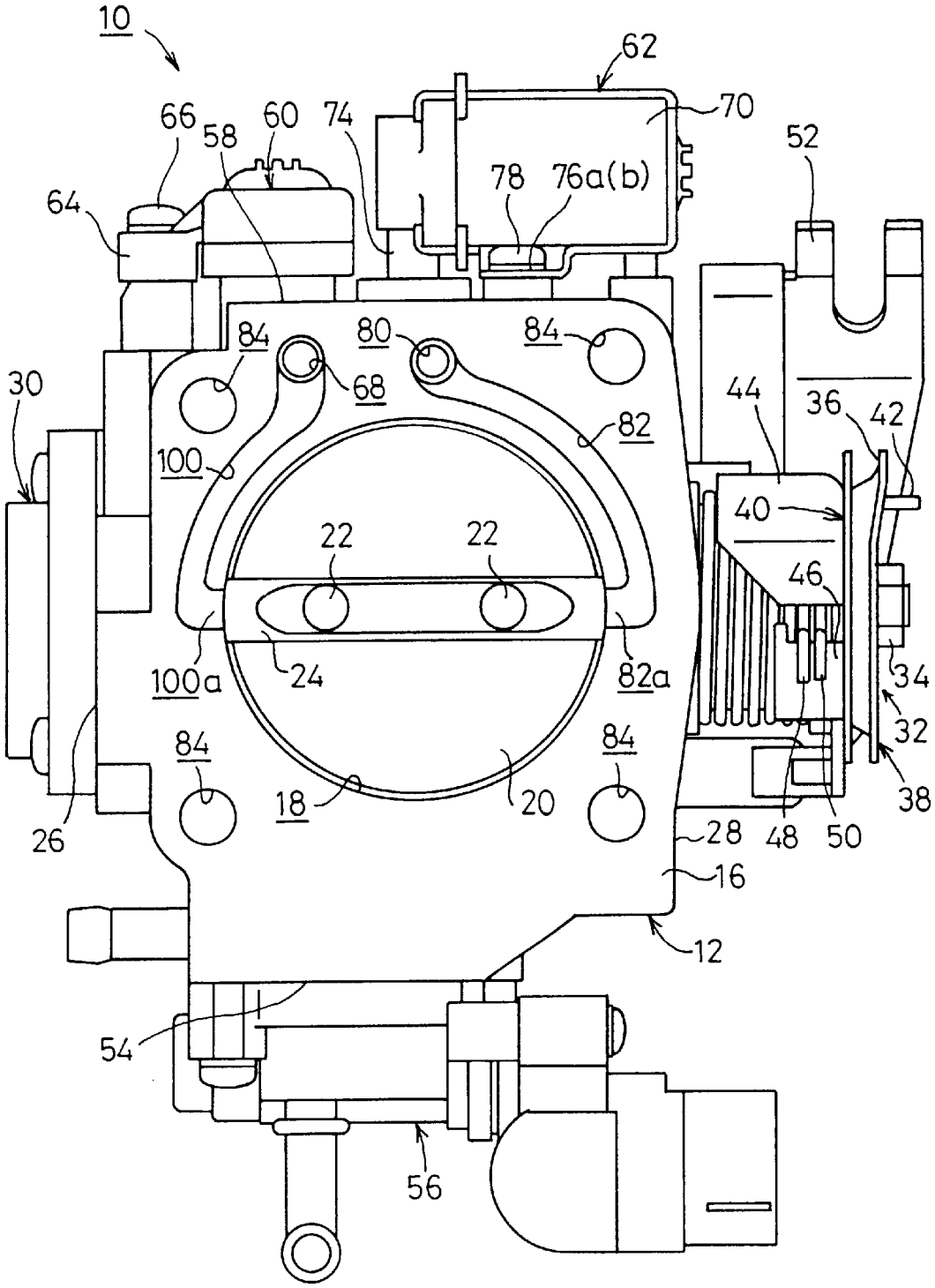
FIG. 4 shows a bottom view illustrating a modified embodiment of the throttle valve control apparatus according to the embodiment of the present invention.

A modified embodiment of the throttle valve control apparatus 10 according to the embodiment of the present invention is shown in FIG. 4. A throttle valve control apparatus according to this modified embodiment includes an aspirating passage 100 which communicates with the negative pressure passage 68 and which is formed to have a circular arc-shaped cross section having a substantially constant width along the outer circumference of the aspirating passage 18 so that the outlet surface 16 of the main throttle body 12 may be cut out. An outlet 100*a* of the aspirating passage 100 communicates with the intake passage 18 at a position (in the vicinity of the throttle shaft 24) where the axis of the throttle shaft 24 is translated in parallel in the axial direction of the intake passage 18. Accordingly, the air fed to the engine is aspirated from the interior of the intake passage 18 formed in the main throttle body 12, and the pressure in the intake passage 18 is detected by the negative pressure sensor 60.

What is claimed is:

1. A throttle valve control apparatus provided with a purge control valve for controlling a flow rate of evaporating fuel to be purged to an intake passage formed in a main throttle body, wherein:

said purge control valve is directly connected to a surface which is substantially parallel to a throttle shaft of said main throttle body, and wherein:

a discharge nozzle of said purge control valve communicates with a purge passage which is formed on an end surface of said intake passage of said main throttle body in an axial direction, and a communicating section between said intake passage and said purge passage is provided at the inside of a wall surface of said main throttle body which holds said throttle shaft.

2. The throttle valve control apparatus according to claim 1, wherein said purge passage is formed to have a circular arc-shaped configuration having a substantially constant width along an outer circumference of said intake passage.

3. The throttle valve control apparatus according to claim 1, further comprising an aspirating passage which is formed to have a circular arc-shaped cross section having a substantially constant width along an outer circumference of said intake passage so that an outlet surface of said main throttle body may be cut out, wherein said aspirating passage communicates with said intake passage.

4. The throttle valve control apparatus according to claim 1, wherein said throttle valve control apparatus is used by being connected to an intake manifold for feeding air into a cylinder chamber of a fuel injection engine of an automobile.

5. The throttle valve control apparatus according to claim 4, wherein said intake passage is opened when an accelerator pedal of said automobile is pedaled, and said intake passage is closed when operation of said accelerator pedal is ceased.

6. The throttle valve control apparatus according to claim 5, further comprising an aspirating passage which is formed to have a circular arc-shaped cross section having a substantially constant width along an outer circumference of said intake passage so that an outlet surface of said main throttle body may be cut out, wherein said aspirating passage communicates with said intake passage.

* * * * *